US011825874B2

(12) United States Patent
Lucente

(10) Patent No.: US 11,825,874 B2
(45) Date of Patent: Nov. 28, 2023

(54) DEVICE FOR TRIMMING THE TIP OF A CIGAR

(71) Applicant: Cigarmedics, Inc., Steger, IL (US)

(72) Inventor: Luigi Lucente, Steger, IL (US)

(73) Assignee: Cigar Medics, Inc., Steger, IL (US)

( * ) Notice: Subject to any disclaimer, the term of this patent is extended or adjusted under 35 U.S.C. 154(b) by 130 days.

(21) Appl. No.: 17/522,269

(22) Filed: Nov. 9, 2021

(65) Prior Publication Data

US 2023/0148079 A1 May 11, 2023

(51) Int. Cl.
*A24F 13/26* (2006.01)

(52) U.S. Cl.
CPC ..... *A24F 13/26* (2013.01)

(58) Field of Classification Search
CPC ..... A24F 13/26; A24F 13/24
USPC ..... 30/109–114, 241–244, 278, 248; 131/248–252, 253, 328; D27/195; 83/13
See application file for complete search history.

(56) References Cited

U.S. PATENT DOCUMENTS 291,509 A * 1/1884 Gratz et al. ..... B27B 27/04 235/91 R
567,277 A * 9/1896 Lehmann et al. ..... A24F 13/24 30/110
951,467 A * 3/1910 Walker ..... A24F 13/26 131/250
1,550,314 A * 8/1925 Hammer ..... B65H 29/12 198/848
1,850,314 A * 3/1932 Bushaw ..... A24C 1/24 83/694
5,694,691 A * 12/1997 Chen ..... A24F 13/26 30/112
5,765,569 A 6/1998 Kemanjian
6,907,886 B2 6/2005 Kemanjian
7,503,329 B2 3/2009 Lenart
8,171,940 B2 5/2012 Chuan
8,656,595 B2 2/2014 Wong
9,119,422 B2 9/2015 Lance
10,736,353 B1 8/2020 Sharp
2007/0107576 A1* 5/2007 Chen ..... B26F 1/36 83/669
2010/0257741 A1* 10/2010 Lin ..... A24F 13/26 30/112

* cited by examiner

*Primary Examiner* — Ghassem Alie
(74) *Attorney, Agent, or Firm* — Rockman Videbeck & O'Connor

(57) ABSTRACT

A cigar cutter has a housing into which a moveable actuator assembly extends. A rotatable cutter blade is located in a hollow space of the housing, the cutter blade rotating in the hollow space under the control of the moveable actuator assembly. A receptacle adjacent the rotatable cutter blade receives the tip of a cigar, and rotation of the cutter blade in the hollow space severs the cigar tip from the remainder of the cigar. The residue formed by the severed tip is then discarded. A hemispherical-shaped cut is created at the tip of the cigar.

11 Claims, 7 Drawing Sheets sec AA
(closed pos.)

sec BB sec CC sec DD

DEVICE FOR TRIMMING THE TIP OF A CIGAR

TECHNICAL FIELD

The present invention relates to a cutter implement for cutting the tip off of a cigar, and in particular an implement to make a hemispherical-shaped surface area cut through the tip of a cigar prior to lighting and smoking the cigar.

BACKGROUND

When purchased, a cigar normally has at least one end sealed. Prior to a user smoking a cigar, it is desirable to trim or cut the tip of the cigar for a brief axial distance on the end that is to be placed in the user's mouth. This cut enables the user to initially draw air through the wrapped tobacco to light the opposite end of the cigar, and then to allow the user to draw the desired smoke axially through the cigar and into the user's mouth.

Various trimming and cutting devices have been developed to provide a suitable sized and shaped opening in the cigar tip for this purpose. Instruments that have been used in the past include knives, pointed implements, and the like. More sophisticated trimmers or cutters have been developed that use a pair of co-planer movable blades to slice off a portion of the cigar tip, creating an annular, radially extending surface on the cigar tip. Other implements drill out the tobacco at the tip of the cigar, creating a cylindrical-shaped opening along a short axial length of the cigar. Each of these types of cutters can produce a ragged mouth-end for the cigar, which reduces the pleasure of smoking a cigar having a smooth end to be inserted into the mouth.

Another type of cigar trimmer or cutter has a cylindrical shaped blade that slides axially for a short distance into the tip of the cigar to cut a cylindrical-shaped tobacco plug that is removed and discarded upon subsequent withdrawal of the cylindrical cutter from the cigar. In these devices, cutting into the tobacco becomes increasingly more difficult as the blade becomes duller after many uses, since the blade is forced axially against the tobacco packed inside the cigar wrapper.

Existing cigar trimming and cutting devices also leave a limited amount of surface area formed by the cut, limiting the amount of air that can be drawn through the cigar. It has been determined that a hemispherical-shaped surface area trim or cut at the mouth end of the cigar will allow more air to be drawn into and through the cigar upon each inhale by the user, since it is well known that for a given size or shape of a three-dimensional configuration, a spherical or hemispherical surface results in the maximum surface area.

U.S. Pat. No. 5,765,569 discloses a cigar cutter that includes a cylindrical blade for cutting and removing a cylindrical-shaped plug from the end of the cigar. Clockwise rotation of a mandrel inserted into the hollow center of the cutter blade causes the cylindrical blade to rotate and extend outwardly from a blade cover. When the blade cover is placed against an end of a cigar, the rotation and axial movement of the blade cuts a cylindrical plug in the tip of the cigar. The plug is removed from the blade by retracting the blade into the mandrel. This device cuts a cylindrical, and not a partly spherical surface into the tip of the cigar, therefore not creating a maximum amount of surface area through which air can pass upon inhaling.

U.S. Pat. No. 6,907,886 also discloses a cigar tip plug cutter with a cylindrical cutting blade to cut a round, cylindrical shaped plug from the tip of the cigar. In this patent's disclosure, the cigar is urged against a receiving plate and the cylindrical blade by the user, and the cigar is twisted about a central axis. The blade cuts a cylindrical plug through the cigar tip. Upon movement of the cigar away from the cutter blade and pressure is applied to a lower surface of the bore, an ejector rod ejects the plug from the cylindrical blade. The device disclosed in this patent does not create a partly spherical shaped surface area in the tip of the cigar.

U.S. Pat. No. 8,171,940 also discloses a cigar trimming device wherein a cigar tip is urged and rotated against a stationary annular or cylindrical shaped blade that cuts a cylindrical plug from the cigar. The blade portion is then rotated upward against a push pole that ejects the tobacco plug from the cylindrical blade. The device disclosed in this patent does not create a partially spherical shaped surface area in the tip of the cigar.

Other types of scissor-tip cigar trimming or cutting devices that create an annular, radial extending surface on the tip of the cigar, and not a partly spherical surface area, are disclosed in U.S. Pat. Nos. 8,656,595; 9,119,422; 10,736,353; and 11,038,218.

SUMMARY

These and other aspects of the present disclosure are disclosed in the following detailed description of the embodiments, the appended claims and the accompanying figures.

The presently disclosed cigar cutter has a housing into which a moveable actuator assembly extends. The housing also includes a rotatable generally spherical shaped cutter blade in a hollow space of the housing, the cutter blade capable of rotative motion in the hollow space under the control of the moveable actuator assembly. A receptacle adjacent the rotatable cutter blade receives a cigar whose tip is desired to be severed. The actuator assembly moves in the housing between a first position where the cutter blade is in an inert first insert position, and a second position where the cutter blade has traversed a hemispherical surface area path in a portion of the cigar.

The presently disclosed subject matter also includes a method of trimming the tip of a cigar by locating the tip of the cigar adjacent and in the projected path of a rotatable partial spherical-shaped cutting blade having a sharp blade edge, and rotating the cutting blade and sharp blade edge into the tip of the cigar and severing the tip of the cigar from the remainder of the cigar. The residue of the severed tip is collected and discarded. A partial spherical or hemispherical cut is formed in the tip of the cigar by the rotating cutting blade.

Prominent advantages to having a hemispherical cut at the mouth end of the cigar are that the hemispherical cut adds more surface area than a straight cut of the same diameter, and the hemispherical cut provides a more uniform draw compared to a cat's-eye shape of a V-cut. Also, the user's "mouth feel" is improved with less interference with the user's tongue due to the cupped-out shape at the mouth end of the cigar.

DETAILED DESCRIPTION

Figure 1:
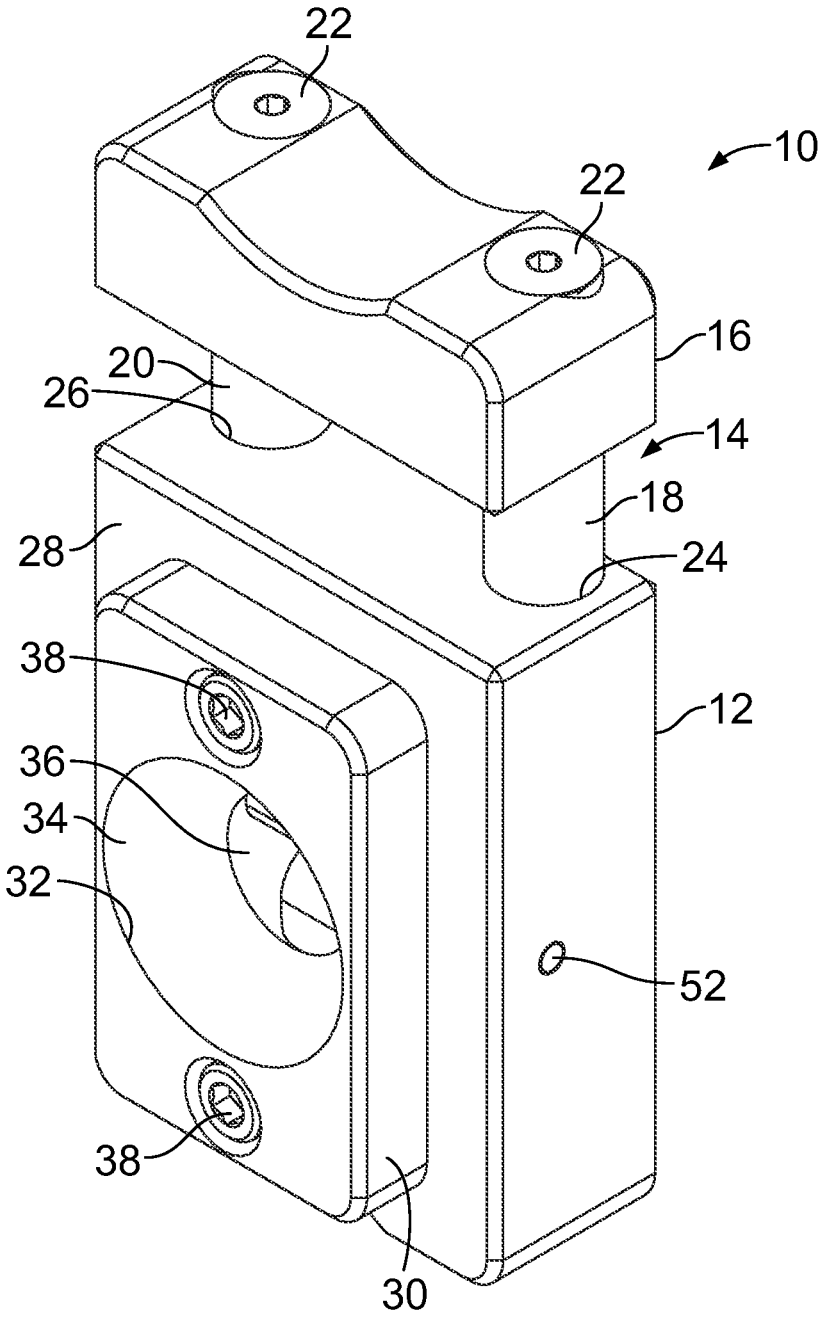
FIG. 1 is a perspective view of a cigar tip spherical cutter assembly according to an embodiment of the present invention, shown in the open or non-cutting position.
Figure 2:
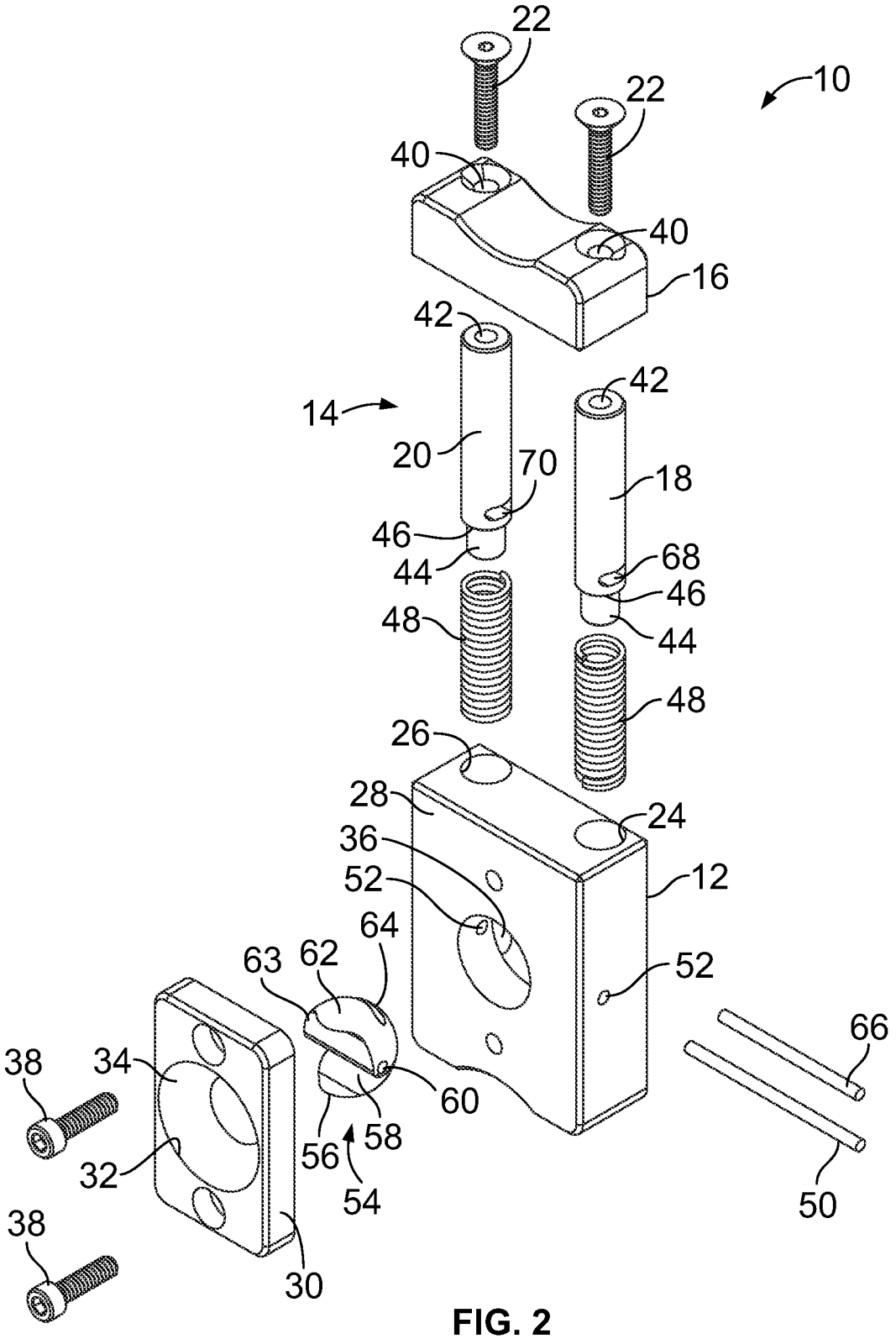
FIG. 2 is an exploded perspective view of the embodiment of the cigar tip spherical cutter assembly shown in FIG. 1.
Figure 3:
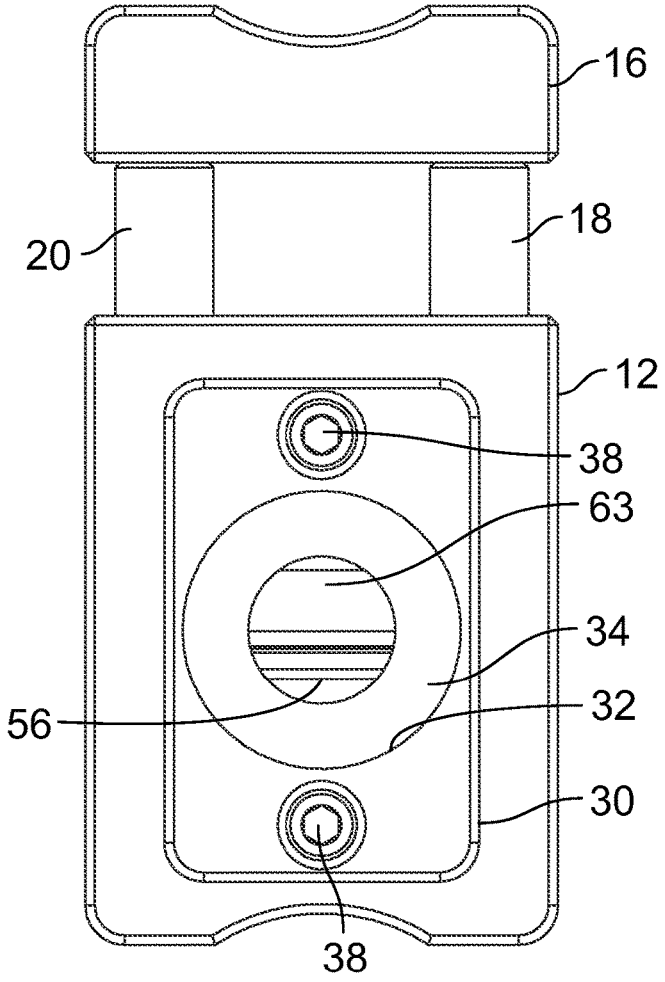
FIG. 3 is a front elevation view of the embodiment of the cigar tip spherical cutter assembly shown in FIG. 1.
Figure 4:
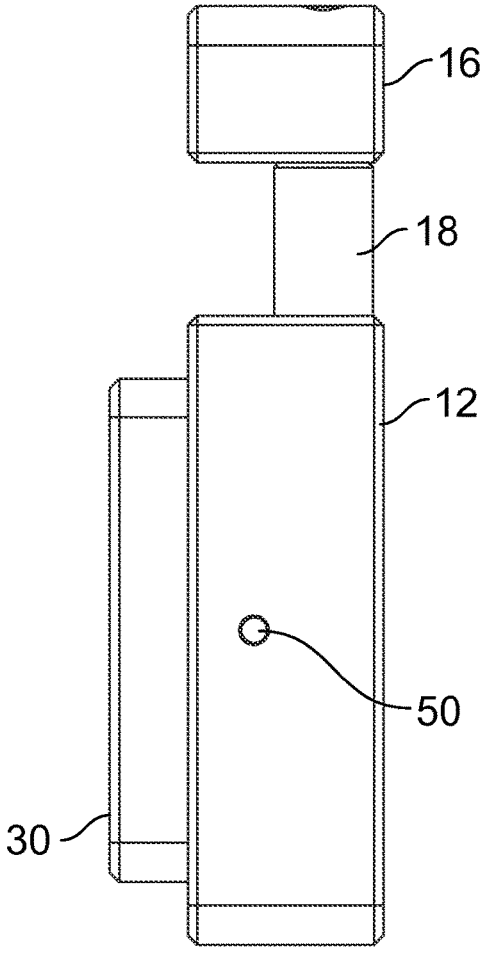
FIG. 4 is a side elevation view of the embodiment of the cigar tip spherical cutter assembly shown in FIG. 1.
Figure 5:
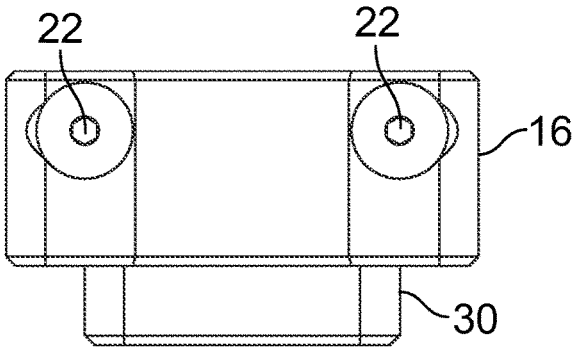
FIG. 5 is a top plan view of the embodiment of the cigar tip spherical cutter assembly shown in FIG. 1.

Referring to FIGS. 1 and 2 of the drawings, the cutter assembly 10 comprises a generally rectangular housing 12. An actuator plunger assembly 14 includes a cross-piece 16 with two downwardly extending cylindrical shafts 18, 20 firmly attached to cross-piece 16 by screws 22. Each shaft 18, 20 is vertically moveable in cylindrical channels 24, 26, respectively, which channels extend vertically through housing 12.

Attached to a front wall 28 of housing 12 is a generally rectangular panel 30 having an access portal 32 formed with a curved conical shaped receptacle 34. Access portal 32 and receptacle 34 open into a first hollow space 36 in the interior of housing 12, as will be explained. Panel 30 is attached to front wall 28 by screws 38, or any other suitable attachment device that is known in the art.

Referring to FIG. 2, screws 22 extend through apertures or channels 40 in cross-piece 16. The screws 22 then are rotated into threaded channels 42 to attach shafts 18 and 20 firmly to cross-piece 16. The bottom of each shaft 18, 20 comprises a portion 44 having a lesser diameter than the remainder of shaft 18 or shaft 20, and a radial surface 46 forms a shelf. Springs 48 receive corresponding portions 44 of shafts 18 and 20, and springs 48 along with shafts 18 and 20 extend into corresponding tubular shaped channels 24 and 26 in the illustrated embodiment of FIG. 2.

As illustrated in FIGS. 2 and 6-11, a first rod 50 extends through channel 52 that extends substantially through housing 12. There is a break in channel 52 as it crosses first hollow space 36, and first rod 50 is held firmly in place by the side portions of housing 12 that extend laterally outwardly from first hollow space 36.

Mounted for rotation about first rod 50 is a substantially spherically shaped cutter blade 54 having a sharp blade edge 56 at a forward end 58 of cutter blade 54. A channel 60 extends through the body 62 of cutter blade 54, and first rod 50 extends through channel 60. In the illustrated embodiment, body 62 of cutter blade 54 is firmly attached to first rod 50, and first rod 50 rotates in channel 52 as cutter blade 54 rotates, as will be explained. Alternately, body 62 of cutter blade 54 may be rotatably mounted on first rod 50, while first rod 50 is firmly lodged against rotation in channel 52. The body 62 of cutter blade 54 also includes an abutment plate 63 adapted to receive the tip of a cigar when the tip is inserted into receptacle 34, as shown in FIG. 8 and as will be explained.

A portion of the circumferential surface of cutter blade 54 approximately 180 degrees from blade edge 56 comprises an open slot 64. The ends of a second rod 66 are lodged for lateral movement in slots 68, 70 of shafts 18, 20, respectively. A central portion 72 of second rod 66 rests in slot 64, and the ends of second rod 66 are adapted to slide laterally in slots 68, 70 as cutter blade 54 rotates about (or with) first shaft 50.

Figure 7:
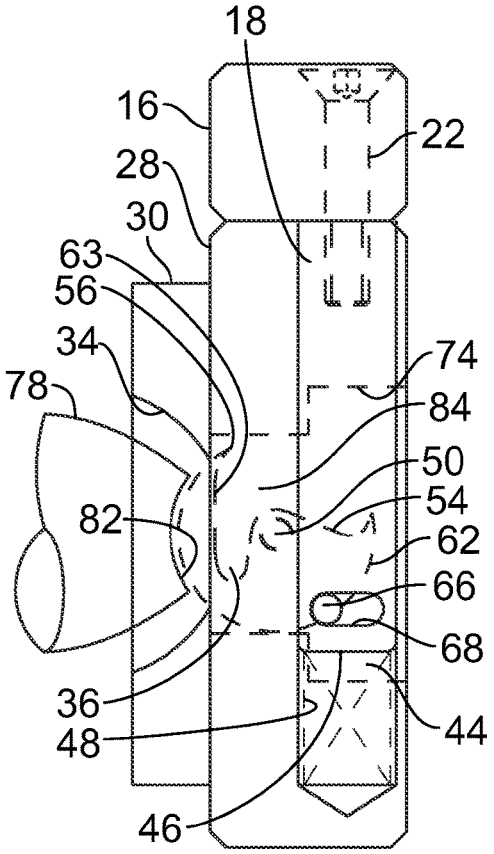
FIG. 7 is a side elevation phantom view of the embodiment of the cigar tip spherical cutter assembly shown in FIG. 1, taken along line A-A of FIG. 6 and showing the plunger assembly and spherical cutter blade in the closed position after cutting the tip of the cigar.
Figure 8:
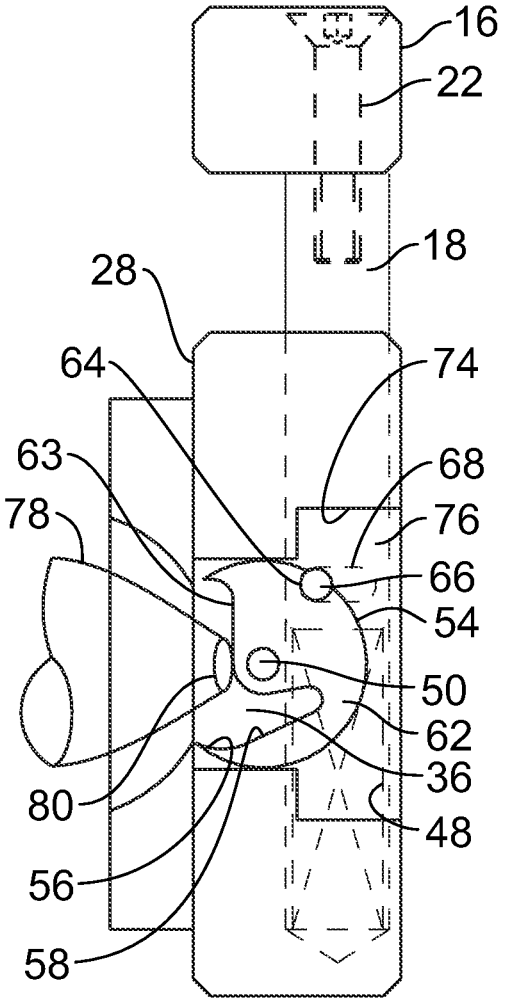
FIG. 8 is a side elevation phantom view of the embodiment of the cigar tip spherical cutter assembly shown in FIG. 1 taken along line B-B of FIG. 6.
Figure 9:
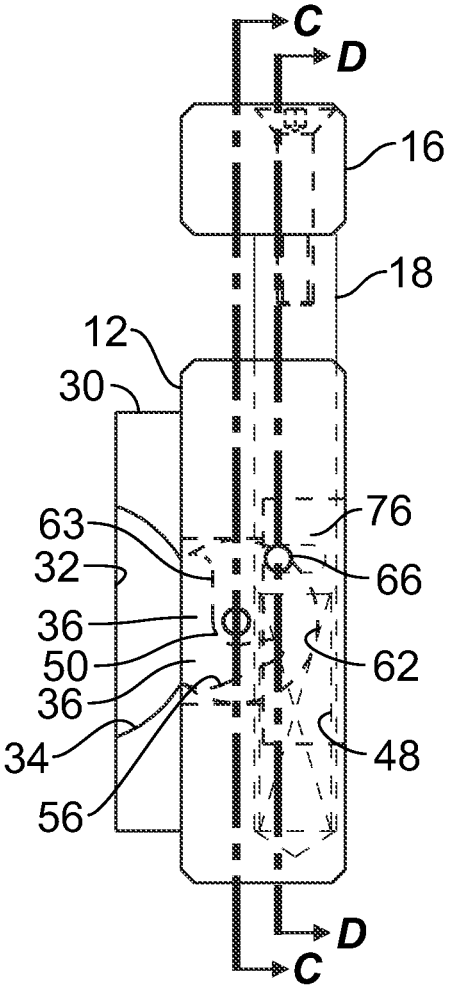
FIG. 9 is a side elevation view of the embodiment of the cigar tip spherical cutter assembly shown in FIG. 1, showing in phantom lines hidden views of certain internal elements of the assembly and showing the plunger assembly and spherical cutter blade in the open position prior to cutting the tip of the cigar.
Figure 10:
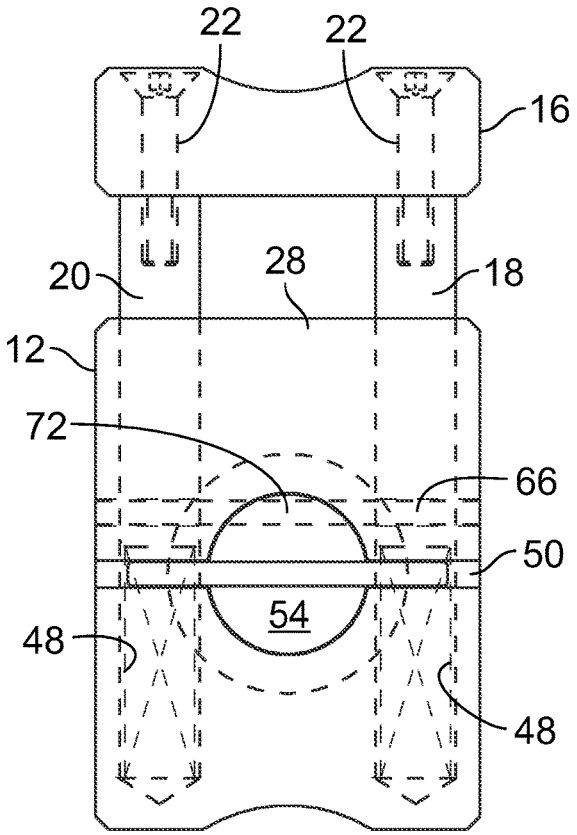
FIG. 10 is a front elevation phantom view of the embodiment of the cigar tip spherical cutter assembly shown in FIG. 1, taken along line C-C of FIG. 9.
Figure 11:
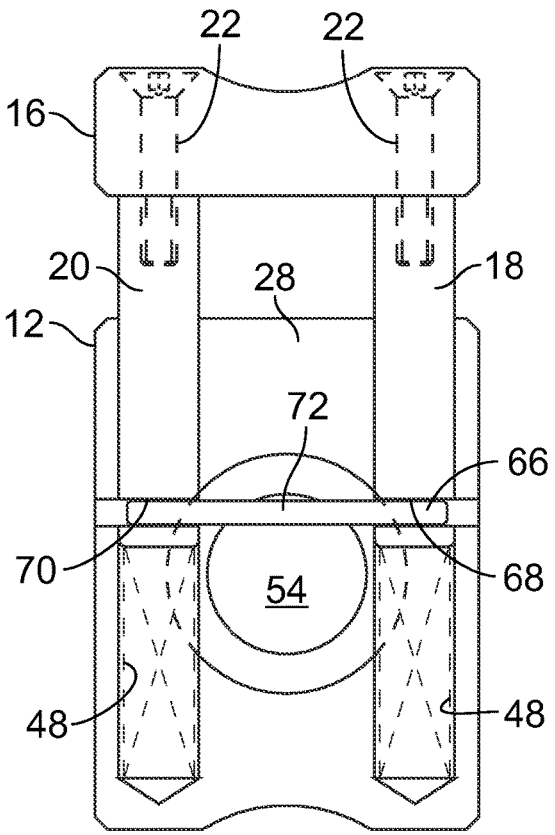
FIG. 11 is a front elevation phantom view of the embodiment of the cigar tip spherical cutter assembly shown in FIG. 1, taken along line D-D of FIG. 9.

As seen best in FIGS. 7, 8 and 9, first hollow space 36 in housing 12 is circular in shape and has an inner diameter slightly larger than the diameter of cutter blade 54, thus allowing cutter blade 54 to rotate freely on a horizontal axis in hollow space 36. Adjacent to first hollow space 36, housing 12 also includes a second circular hollow space 74 having a diameter greater than the diameter of first hollow space 36. Second hollow space 74 provides an opening 76 through housing 12, as seen in FIGS. 7, 8 and 9.

Figure 6:
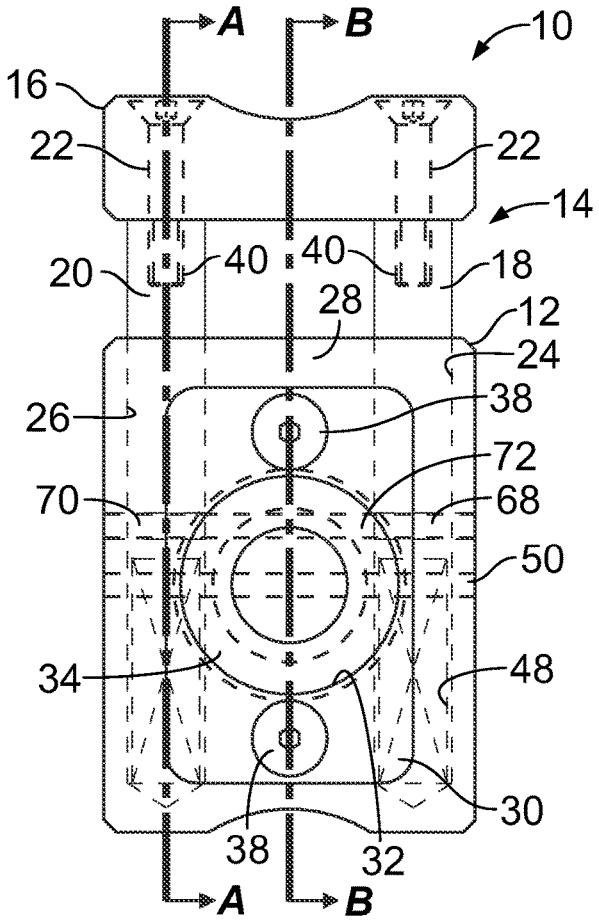
FIG. 6 is a front elevation view of the embodiment of the cigar tip spherical cutter assembly shown in FIG. 1, showing in phantom lines hidden views of certain internal elements of the assembly.

Referring to FIGS. 6, 7 and 8, a more detailed illustration of the assembly and operation of the embodiment of FIGS. 1 and 2 are shown. Before lighting cigar 78 (FIGS. 7, 8), the tip of the cigar to be inserted into the mouth of the user is inserted in receptacle 34 of panel 30 and urged against abutment plate 63, which abutment plate is located a short distance beyond the plane of front wall 28 of housing 12, as shown in FIG. 8. The user then applies pressure to cross-piece 16, advancing cylindrical shafts 18, 20 downward into channels 24, 26 of housing 12 and against the bias of springs 48.

As shafts 18, 20 move downward, rod 66 lodged in open slot 64 moves downward, forcing cutter blade 54 to rotate about rod 50 as rod 66 applies pressure at the circumferential surface of cutter blade 54. Since rod 66 is acting upon the surface of cutter blade 54, there is also a simultaneous lateral component of movement to rod 66. This lateral movement is allowed since the ends of rod 66 are supported in slots 68, 70 in shafts 18, 20, respectively (FIGS. 2, 7) as cutter blade 54 rotates around, or with, rod 50.

Figure 12A:
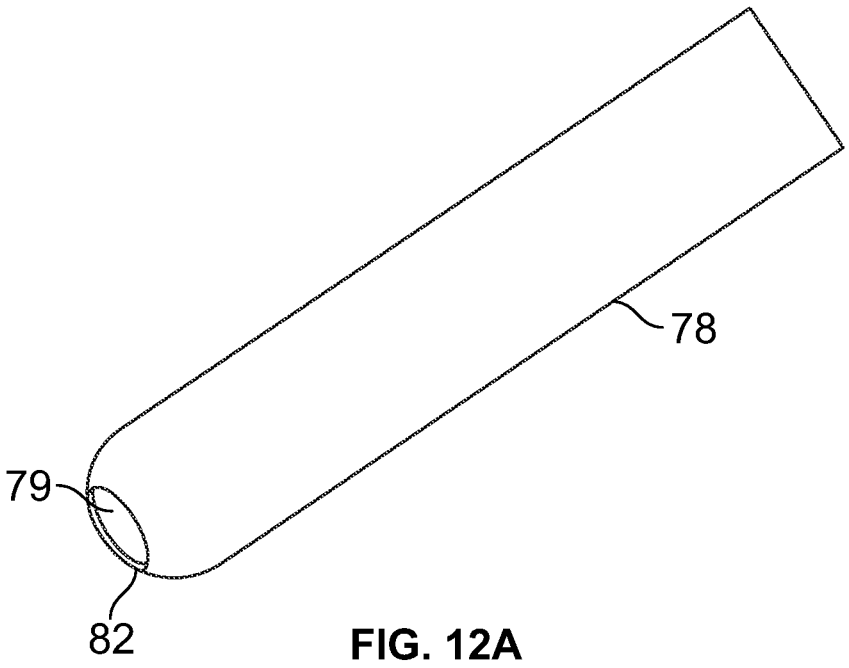
FIGS. 12A and 12B are perspective and side views, respectively, of a cigar after completion of the cutting process showing the hemispherical-shaped cut at the mouth end of the cigar.
Figure 12B:
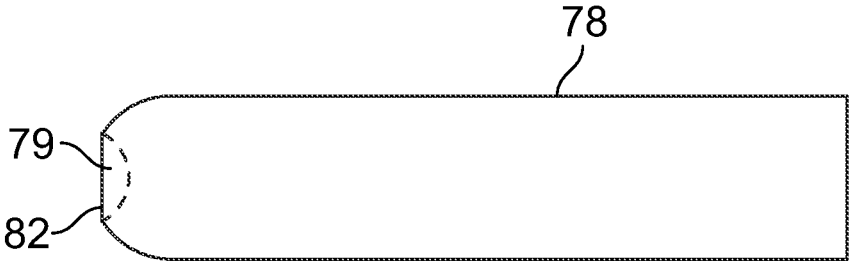

Referring to FIGS. 2, 7 and 8, as cutter blade 54 rotates in a clockwise direction relative to rod 50, sharp cutter blade edge 56 enters the tip of cigar 78 at an axial location a short distance from the end 80 (FIG. 7) of the cigar, and trims off a residue portion 84 of the cigar tip from the end 80 of the cigar. Since cutter blade edge 56 is rotating in a circular direction, and since the body 62 of cutter blade 54 is spherical, a hemispherical surface area portion 79 (FIGS. 12A and 12B) is formed on the new trimmed end 82 (FIG. 7) of cigar 78. This hemispherical surface area portion 79 has a larger surface area at the new tip 80 of the cigar, compared to the surface area that would be formed were parallel-moving cutter blades applied to the tip of cigar 78, or compared to the surface area remaining where a cylindrical plug removed from the tip of the cigar. As a result of this larger surface area, an advantage is provided to the user who can draw more air into the cigar while lighting the cigar, and while smoking the cigar. After the cigar tip has been trimmed as described above, the cigar 78 is axially withdrawn from receptacle 34, and is ready to be smoked.

Referring to FIG. 7, which illustrates the position of cutter blade 54 subsequent to removal of a portion of the tip 78 from the cigar, the residue 84 of tobacco removed from the tip of the cigar is deposited in hollow space 36. After rotation of cutter blade 54 to the position shown in FIG. 7, first hollow space 36 is in direct communication with second hollow space 74 and rear opening 76 of housing 12. While still applying downward pressure to cross-piece 16, the user can hold housing 12 in a somewhat horizontal position, and shake residue 84 out of housing 12 through second hollow space 74 and through rear opening 76. Then, pressure on cross-piece 16 is released, and cylindrical shafts 18, 20 move upward in housing 12 under the force of springs 48. As shafts 18, 20 move upward, cutter blade 54 and rod 50 return to their original inert position, as shown in FIGS. 8 and 9, and cutter assembly 10 is ready for subsequent uses.

While the description above refers to an embodiment of the disclosed cigar cutter device, it will be understood that modifications may be made to the disclosed embodiment without departing from the spirit of the invention. The accompanying claims are intended to cover such modified embodiments, as well as the disclosed embodiment, as fall within the true scope and spirit of the invention.

What is claimed is:

1. A cigar cutter, comprising:

a housing;

a moveable actuator assembly extending into the housing;

a hemispherically shaped rotatable cutter blade in the housing, the hemispherically shaped rotatable cutter blade operatively connected to the actuator, the hemispherically shaped rotatable cutter blade disposed in at least one hollow space in the housing, the hemispherically shaped rotatable cutter blade including a sharp cutter blade edge, the sharp cutter blade edge having a hemispherically shaped outer surface, the sharp cutter blade edge traversing a hemispherical surface area path;

the hemispherically shaped rotatable cutter blade comprising a hemispherical shaped outer surface;

a receptacle adjacent the at least on hollow space, the receptacle and the at least one hollow space adapted to receive the tip of the cigar when the tip of the cigar is extended into the at least one hollow space and adjacent the sharp cutter blade edge;

the actuator assembly moveable between a first position in the housing where the hemispherically shaped rotatable cutter blade is in a first inert rotative position, and a second position where the hemispherically shaped rotatable cutter blade edge has traversed the hemispherical surface area path from the first position to the second position.

2. The cigar cutter of claim 1, wherein:

a panel is mounted to a front wall of the housing, the receptacle formed in the panel.

3. The cigar cutter of claim 2, wherein:

the front wall of the housing extends in a first plane, a rear surface of the panel extending in said first plane, the sharp cutter blade edge rotatable by action of the moveable actuator assembly between the first position where the sharp cutter blade edge is disposed in the housing and inwardly of the first plane of the front wall and the second position where the sharp cutter blade edge rotates in a path outwardly of the first plane of the front wall.

4. The cigar cutter of claim 1, wherein:

the rotatable cutter blade is disposed in the at least one hollow space, the hollow space communicating with an exterior of the housing, the rotatable cutter blade adapted to deposit cigar residue into said at least one hollow space, the residue adapted to be removed from the housing through the at least one hollow space.

5. The cigar cutter of claim 1, wherein:

the rotatable cutter blade is mounted on a rod, the rod having two ends, each rod end supported in a laterally extending slot disposed in the moveable actuator assembly.

6. The cigar cutter of claim 5, wherein:

the rod moveably lodged in an open slot is in contact with the at least one partial spherical outer surface of the rotatable cutter blade and the hemispherical outer surface of the rotatable cutter blade.

7. The cigar cutter of claim 6, wherein:

the rod moves downwardly and laterally upon rotation of the rotatable cutter blade.

8. The cigar cutter of claim 1, wherein:

the moveable actuator assembly is biased to the first position by at least one resilient force member, the at least one resilient force member extending between the housing and the moveable actuator assembly.

9. The cigar cutter of claim 8, wherein:

the at least one resilient force member comprises at least one spring.

10. The cigar cutter of claim 1, wherein:

the rotatable cutter blade includes an abutment plate, the abutment plate adapted to receive the tip of the cigar when the tip of the cigar is inserted into the receptacle.

11. The cigar cutter of claim 1, wherein:

movement of the sharp cutter blade edge in the hemispherical path is adapted to create a hemispherical surface area on an end of the cigar.

* * * * *